US010458741B1

(12) United States Patent
Fischer

(10) Patent No.: US 10,458,741 B1
(45) Date of Patent: Oct. 29, 2019

(54) PISTOL SOCK

(71) Applicant: Dale Fischer, Spring Branch, TX (US)

(72) Inventor: Dale Fischer, Spring Branch, TX (US)

( * ) Notice: Subject to any disclaimer, the term of this patent is extended or adjusted under 35 U.S.C. 154(b) by 0 days.

(21) Appl. No.: 15/989,307

(22) Filed: May 25, 2018

(51) Int. Cl.
*F41A 35/02* (2006.01)

(52) U.S. Cl.
CPC ..... *F41A 35/02* (2013.01)

(58) Field of Classification Search
CPC ..... F41A 35/02; F41A 35/00; F41C 33/02; F41C 33/0209; F41C 33/0218; F41C 33/0227; F41C 33/0236; F41C 33/0245; F41C 33/06
USPC ..... 42/96
See application file for complete search history.

(56) References Cited

U.S. PATENT DOCUMENTS 3,540,508 A * 11/1970 Couch ..... F41C 33/06 206/317
3,669,325 A * 6/1972 Furman ..... F41C 33/0209 224/243
3,720,013 A * 3/1973 McDonald ..... F41C 33/0209 206/317
4,858,361 A * 8/1989 White ..... F41A 35/02 42/96
5,012,965 A * 5/1991 Miller ..... F41C 33/0209 224/230
5,850,706 A * 12/1998 Evans ..... G02B 27/0006 42/96
6,164,004 A * 12/2000 Essary ..... F41A 35/02 42/96
6,402,001 B1 * 6/2002 Madarang ..... F41C 33/008 224/191
D584,054 S * 1/2009 Massie ..... D3/244
D652,469 S * 1/2012 Sayre ..... D22/108
8,757,821 B2 * 6/2014 Quinnan ..... F41G 1/383 359/511
9,482,486 B2 * 11/2016 Kunkel ..... F41C 33/06
D777,287 S * 1/2017 Scott ..... D22/108
D777,288 S * 1/2017 Scott ..... D22/108
2003/0005614 A1 * 1/2003 Cossio ..... F41A 35/04 42/96
2005/0118375 A1 * 6/2005 Damiano ..... F16L 58/04 428/36.1
2005/0279789 A1 * 12/2005 Lowe ..... F41C 33/0209 224/244

(Continued)

OTHER PUBLICATIONS

Sack-ups Pistol Sock: https://www.amazon.com/Sack-Ups-200-13-Pistol-Sock/dp/B0000C52B0; Nov. 2015 (Year: 2015).*

*Primary Examiner* — Joshua A Freeman
(74) *Attorney, Agent, or Firm* — Eric A. Hinojosa

(57) ABSTRACT

The invention described herein concerns a comfort enhancing, pistol protecting gun sock that is compatible with holsters, yet rapidly removable via a convenient pull tab. The present invention addresses the discomfort of carrying pistols in the form of a gun sock that can be attached directly to the user's pistol without disruption to the user's existing carry holster. To accomplish the goal of the present invention, the gun sock comprises joined layers that have certain desired properties such as cushioning, breathability, and/or anti abrasive design. The gun sock is configured to at least partially surround and partially engage with pistol whether it is situated in a holster or not. In some implementations, the pistol can still be fired while the gun sock is engaged.

19 Claims, 19 Drawing Sheets

(56) References Cited

U.S. PATENT DOCUMENTS

| | | | | |
|---|---|---|---|---|
| 2015/0267995 | A1* | 9/2015 | Benton | F41C 33/045<br>224/198 |
| 2016/0169618 | A1* | 6/2016 | Kunkel | F41C 33/002<br>224/150 |
| 2017/0160052 | A1* | 6/2017 | Brown | F41C 33/06 |
| 2018/0356177 | A1* | 12/2018 | Scott | F41A 35/02 |

* cited by examiner

PISTOL SOCK

CROSS-REFERENCE TO RELATED APPLICATIONS

This application does not claim the benefit of another application.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND

Firearms, in particular handguns or more broadly pistols, are carried on a person in a variety of ways. Pocket carry—simple carrying of the pistol in the person's pocket—while not unheard of is less commonly practiced. The vast majority of carrying people utilize a holster. Holsters of various styles are made to allow carry on the chest, hip (outside the waistband), inside the waistband (of the person's pants or shorts), thigh, ankle (lower shin), etc. A common feature of the various holster styles and types is that the holster is designed to only partially receive and surround the pistol. Typically the holster will partially encompass the exiting end of the barrel (the muzzle) or the slide that covers that portion of the barrel. Typical holsters may also partially encompass the trigger and trigger guard area of the frame. Many holsters do not cover or engage with the backstrap (rear grip), the handle (the magazine well), the hammer or the rear of the slide, the grip, the floor plate (the magazine butt), etc. Additionally, the rear area of the pistol frame may have protruding features such as sights, safety switches, slide release levers, the magazine release button, etc. All of these pistol components may therefore be uncovered. An unfortunate side effect is that there is often direct contact with the person's skin that results in painful pressure points. The popular thought is that these areas of the pistol should be uncovered to maximize speed of access—presumably for an emergent situation. However, contrary to the reigning logic in the field of art, many carrying people desire an option that can increase the comfort of carrying. Others desire a product that can protect their pistol from the wear and tear of clothing and skin contact. Others want to add a layer of protection for their stored pistol, to prevent wear and tear from contact with hard surfaces and other items.

In short, there is a long felt need for a more comfort enhancing, pistol protecting product that is compatible with holsters, yet won't hinder access to the pistol in emergent situations.

BRIEF SUMMARY

It is a goal of the present invention to provide a comfort enhancing, pistol protecting gun sock that is compatible with holsters, yet rapidly removable. The present invention addresses the need in the form of a gun sock that can be attached directly to the user's pistol and legacy or existing carry holster. To accomplish the goal of the present invention, the gun sock comprises joined layers that have certain desired properties such as cushioning, breathability, and/or anti abrasive design. The gun sock is configured to at least partially surround and partially engage with pistol whether it is situated in a holster or not.

DETAILED DESCRIPTION

The pistol sock of the present disclosure is described herein according to multiple implementations. As a convention for orientation, the descriptive directions of up, above, on top of, down, under, below, etc. may be used. One having ordinary skill in the art will understand that when a pistol is carried in a holster, it is typically oriented so that the muzzle is oriented downward defining the lowest position while the grip back strap and hammer or the end of the slide opposite the muzzle will be positioned in the highest position. Therefore, terms such as up, above, on top of, etc. will refer to a relative position that is further from the pistol muzzle. And similarly, terms such as down, under, below, etc. will refer to a relative position that is closer to the pistol muzzle.

The present disclosure generally comprises a structure that will be referred to as a gun sock, in that it features an interior enclosed space formed by at least one outer layer having a bottom opening—thus in some ways the implementations resemble a sock (foot garment). However, as disclosed herein there are several adaptations that are specifically present for the receiving, engaging, and releasing of only a part of a pistol type firearm into the interior enclosed space.

Figure 1:
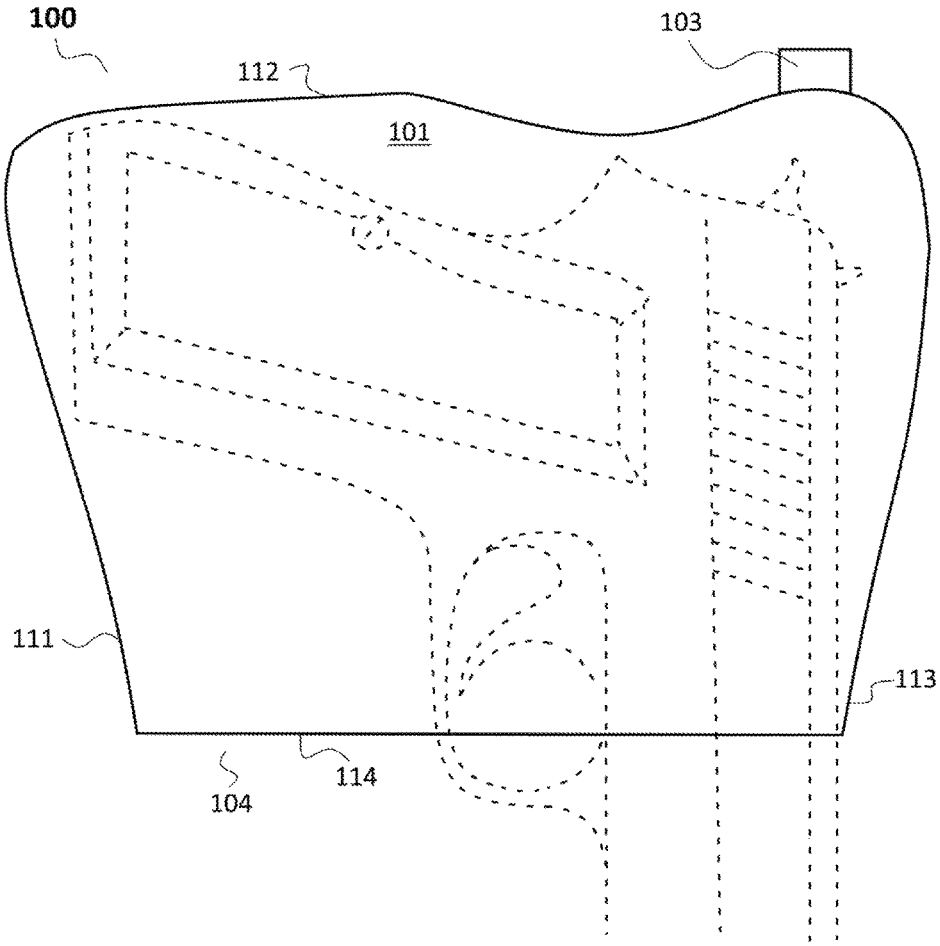
FIG. 1 shows an orthogonal side view of a first implementation of the disclosure fully showing an unclaimed firearm positioned within the gun sock.
Figure 2:
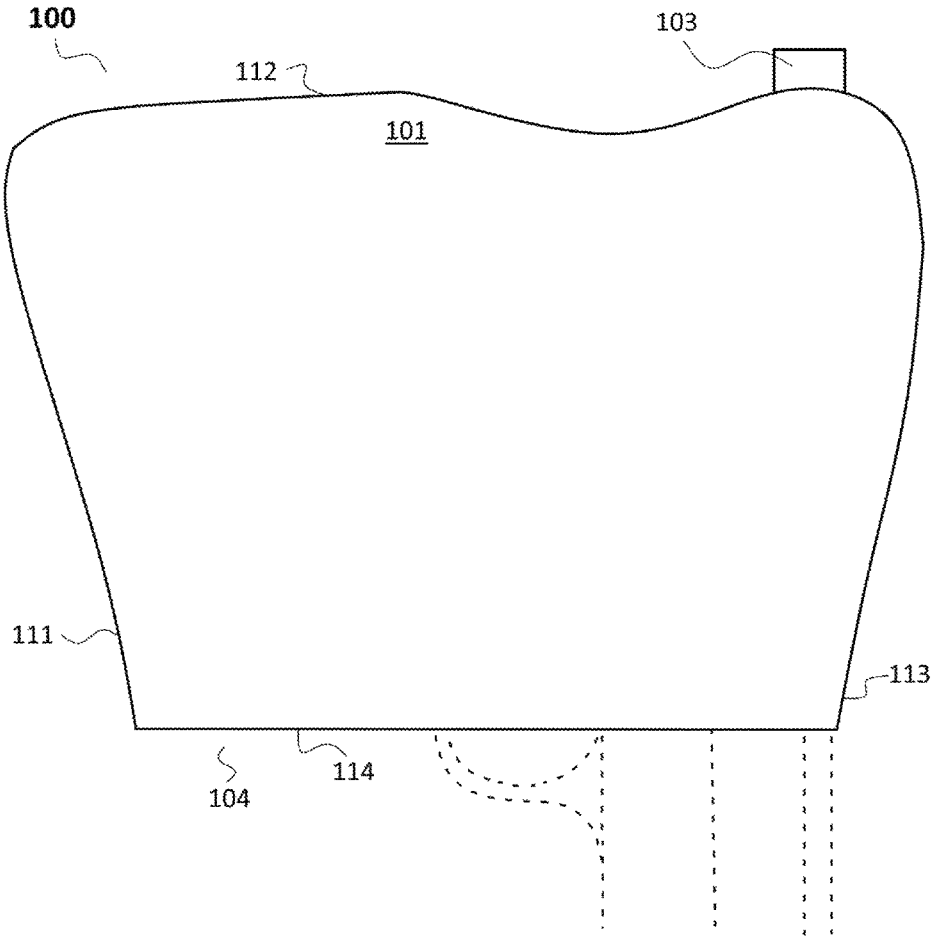
FIG. 2 shows the orthogonal side view of FIG. 1, with the unclaimed firearm only partially visible.
Figure 3:
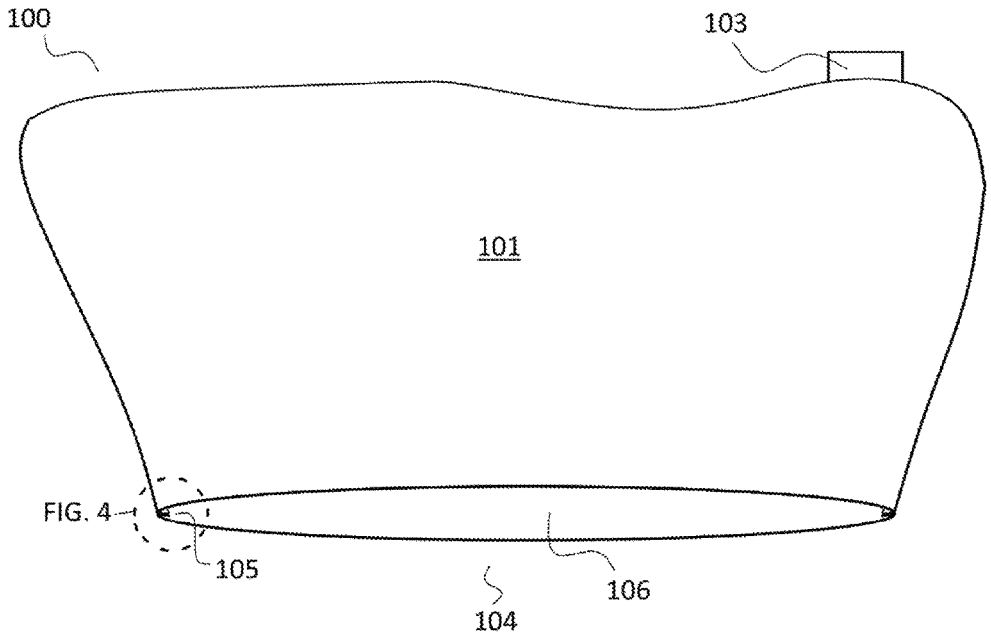
FIG. 3 shows a perspective view of the implementation of FIG. 1, without the unclaimed firearm, in a position where the top of the implementation appears tilted away from the viewer revealing the opening.
Figure 4:
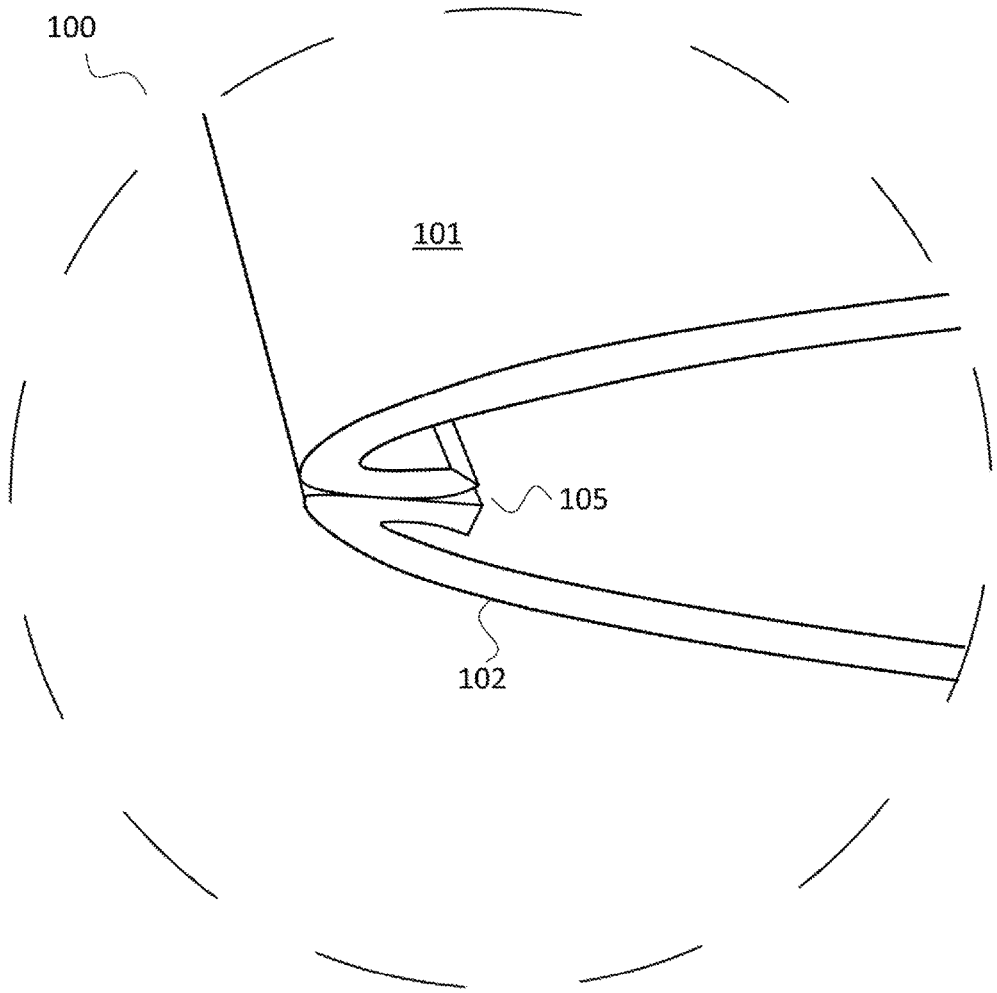
FIG. 4 shows a magnification of the bottom corner of the implementation of FIG. 1 as seen in FIG. 3 to show how the front and back side layers come together.

In a first and basic implementation seen in FIG. 1 and FIG. 2, gun sock 100 comprises two layers having essentially the same substantially trapezoidal shape. The first layer 101 is joined to the second layer 102 along the perimeter of each leaving an opening along one edge. In FIG. 1, gun sock 100 is seen to have four distinct edges that define the perimeter of first layer 101. In this same drawing, second layer 102 is not visible. First layer 101 of gun sock 100 comprises edge 111, edge 112, edge 113, and edge 114. Second layer 102 of gun sock 100 comprises edge 121, edge 122, edge 123, and edge 124. Edge 111 is joined to edge 121, edge 112 is joined to edge 122, and edge 113 is joined to edge 123. However, edge 114 and edge 124 are not joined and thus form opening 104. Turning to FIG. 3 and FIG. 4, the edges 111 and 121 can be seen to be joined by seam 105. The joined edges of first layer 101 and second layer 102 define an interior space 106.

Still discussing gun sock 100 in FIG. 1-4, the first and second layers are substantially trapezoidal. What would be the longest parallel line in the trapezoid is defined by edges 112 and 122 in first layer 101 and second layer 102, respectfully. In some implementation, the length of these edges is adapted to be greater than the sum of the gun width plus the gun height, leaving excess for joining the layers. In other implementations where a specific gun model is not used, the length of the first and second layers will be set to accommodate average or generic gun dimensions of various styles (single stack sub-compact, double stack compact, etc.). In some implementations the elasticity of the materials of composition is taken into account in determining the dimensions of the layers. In all implementations, the interior space is configured to have an internal width that at least partially exceeds the sum of the gun height plus width. Note in the drawings that the pistol hilt, magazine well, the rear of the slide, and the hammer of the pistol fit within the widest portion of the interior space in each implementation. There are additional details on the pistol sock shape and dimensions below.

Note that in gun sock 100, the opening 104 is defined by what would be the smallest parallel side of the substantially trapezoidal shape. This is a preferred shape among the four sided implementations, because the narrower opening improves the engagement of the gun sock on the pistol. Having read the present disclosure it will be understood by one having ordinary skill in the art that other shapes and orientations are possible. Thus the reader will appreciate the present shape and orientation is exemplary and not limiting. Other shapes are indeed expressly described in more detail below.

The first basic embodiment of FIG. 1 and FIG. 2 further comprises a pull tab 103 that is positioned along top of gun sock 100, between edge 112 and edge 122, which is essentially opposite the opening 104. Though pistols come in a variety of shapes and sizes, there are typically two axis lines that can be used as reference, the slide axis and the magazine well axis (or handle axis). The slide axis that defines the center of the slide (or barrel, if the pistol is a revolver or single shot style) runs from the muzzle to the slide backstop or hammer. Since the gun sock can accommodate a wide range of pistols a generic slide axis is calculated based on the overall dimensions of the first and second layers and the typical pistol dimensions that will fit in the resulting interior space. The pull tab 103 is further positioned to be closer to edge 113 and edge 123 than it is to edge 111 and edge 121, to be substantially aligned with the generic slide axis. Positioning the pull tab on or near the generic slide axis results in greater ease and efficiency in removing the gun sock from the pistol compared to other locations.

Figure 5:
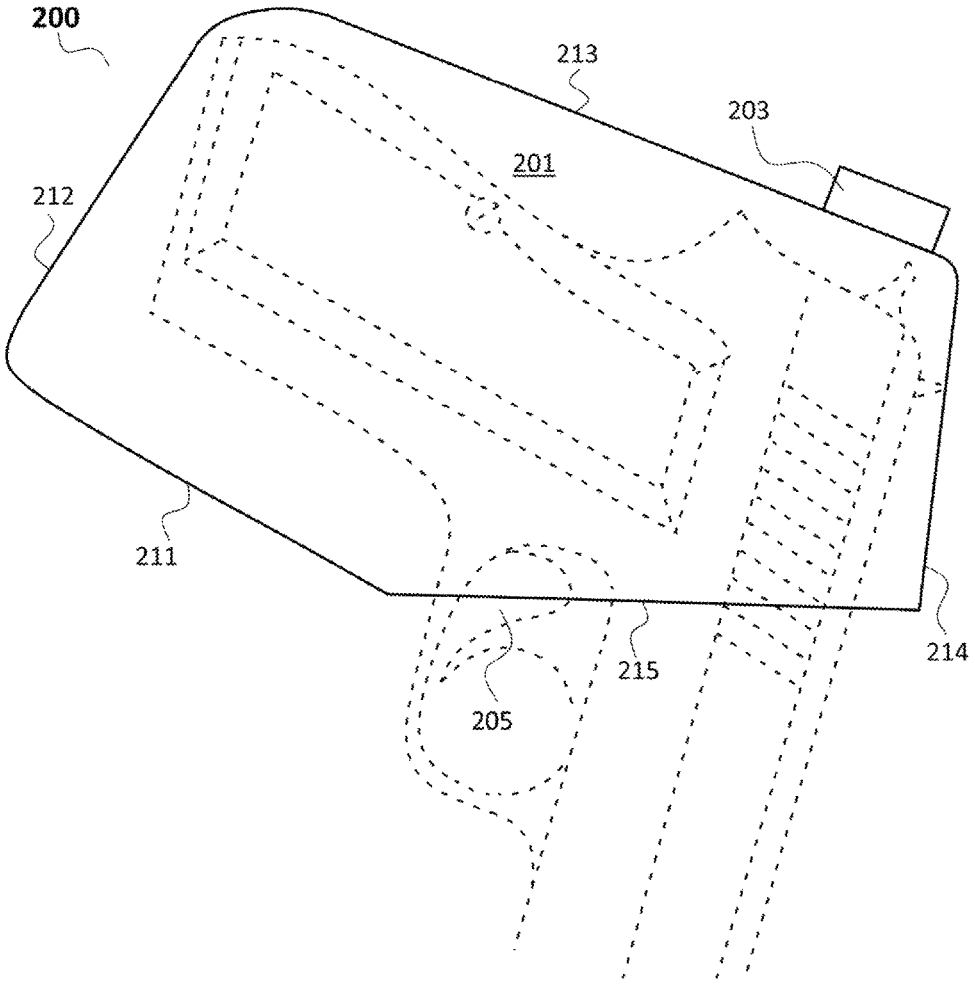
FIG. 5 shows an orthogonal side view of an implementation of the disclosure fully showing an unclaimed firearm positioned within the gun sock.
Figure 6:
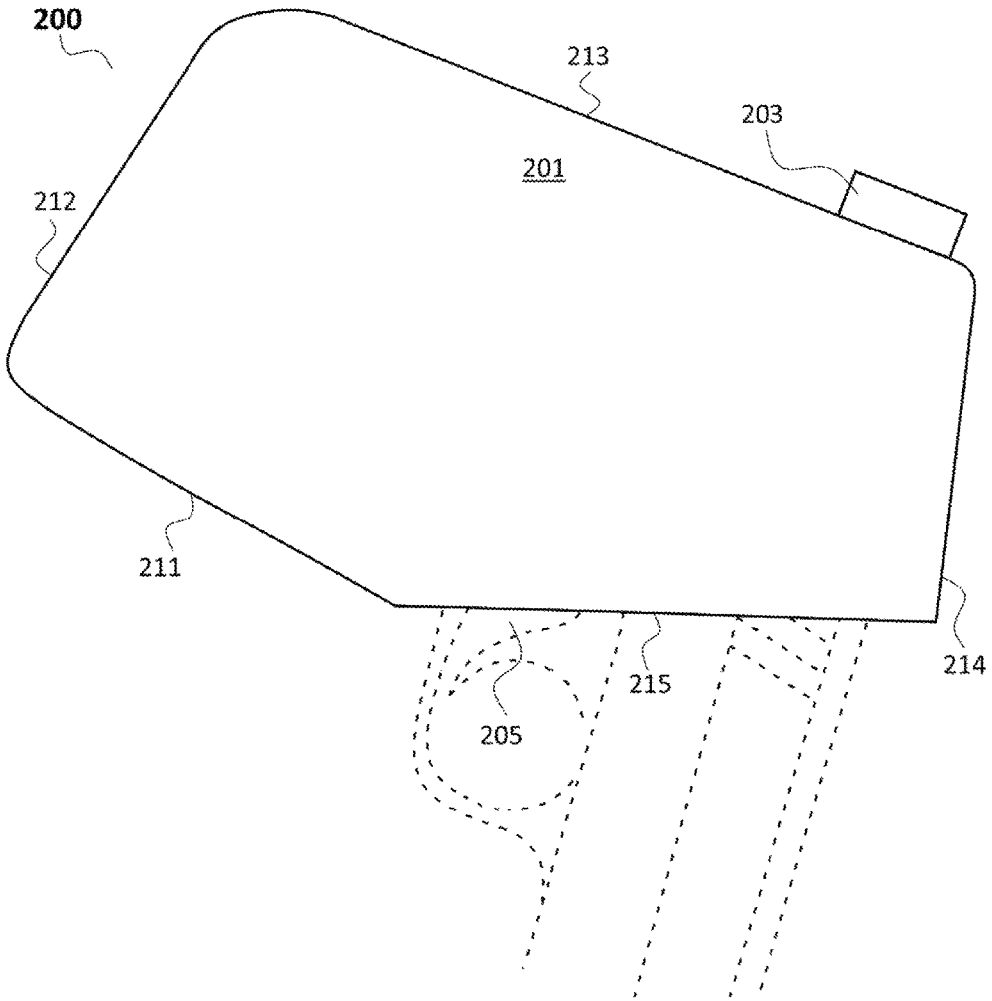
FIG. 6 shows the orthogonal side view of FIG. 5, with the unclaimed firearm only partially visible.

As previously discussed, other implementations have layers with different shapes. Turning now to FIG. 5 and FIG. 6, the implementation referred to as gun sock 200 comprises a first layer 201 and second layer 202 having five edges. First layer 201 has edge 211, edge 212, edge 213, edge 214, and edge 215. Second layer 202 has edge 221, edge 222, edge 223, edge 224, and edge 225. Edge 211 is joined to edge 221, edge 212 is joined to edge 222, edge 213 is joined to edge 223, and edge 214 is joined to edge 224. However, edge 215 and edge 225 are not joined and thus form opening 204. The joined edges of first layer 201 and second layer 202 define an interior space 206.

Still referring to gun sock 200, the interior space 206 much more closely conforms to the pistol form factor. This preferred implementation further improves the engagement of the gun sock with the pistol to resist unintended release or separation of the gun sock from the pistol on which it has been applied. The intersection of edge 211 with edge 215 (on first layer 201), and edge 221 with edge 225 (on second layer 202), becomes a pivot point when the user pulls on pull tab 203 during the removal of the gun sock. This causes the opening 204 to rotate around the back of the slide (and hammer if present) allowing the magazine well (or handle) to slip out easily.

It is well known that pistol holsters come in a variety of shapes and dimensions. Some provide coverage that extends around the pistol trigger or trigger guard area, while others do not engage the pistol in those areas. The shape of gun sock 100 is easily tailored to either avoid or accommodate the trigger and trigger guard area into the interior space 106 thus leaving the parts of the pistol that are engaged by the holster uncovered by the gun sock. In some implementations the trigger guard area is substantially accommodated, such as in gun sock 100. However in other implementations, such as gun sock 200, the trigger guard area is substantially excluded. In this way, both the gun sock and a variety of holsters can be used simultaneously. Notice how in the various implementations (see all figures) when the gun sock is fully positioned over a pistol, the rear of the pistol is situated in the back of the interior space, meaning opposite the opening. Notice further that in each implementation the opening of the gun sock is positioned in the vicinity of the trigger guard of the gun. For example, in gun sock 100 when a pistol is in the interior space 106, the opening 104 is positioned just below the trigger but above the forward most wall of the trigger guard. Similarly, in gun socks 200, 400, 500, 600, 700, and 800, when a pistol is in the interior space, the opening is positioned just above the trigger but below the rear most wall of the trigger guard. In other words, the interior space of each implementation has a depth, measured from the opening to the opposite edge (such as from opening 104 to edge 112 of gun sock 100 seen in FIG. 1). The depth is determined by the length of the side edges (such as edges 111 and 113 in FIG. 1) and the shape of the gun sock layers (such as layers 101 and 102 in FIG. 1). Notice that the depth of each gun sock implementation described herein is less than the distance from the back of the gun to the forward most wall of the trigger guard of the pistol to which it is applied, but in every case greater than the width of the pistol grip. This avoids an excess of gun sock from bunching up against the holster or the person's body while wearing the holster. An excess of gun sock could cause discomfort to the person, could prevent the holster from properly engaging the pistol, could become entangled with the holster preventing proper pistol drawing, could cause fumbling of the pistol when being grabbed, etc.

Figure 7:
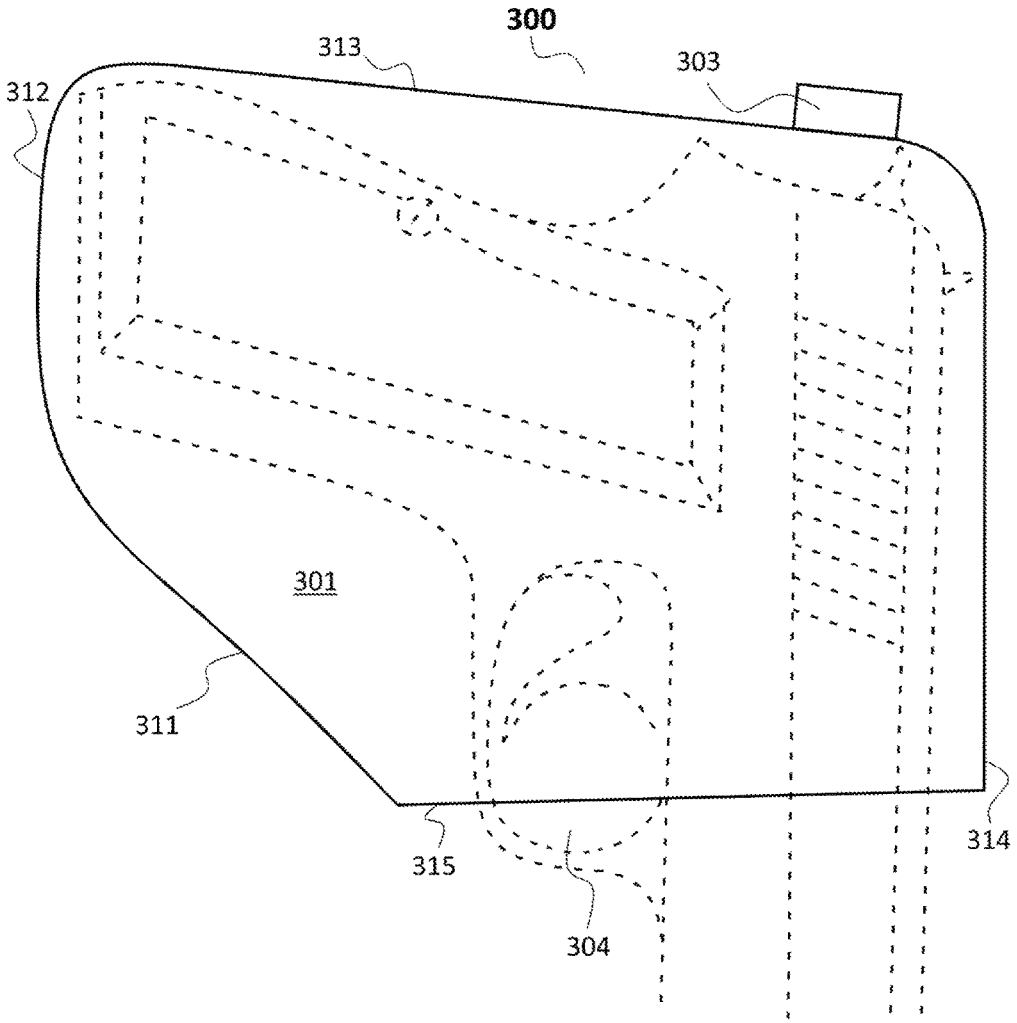
FIG. 7 shows an orthogonal side view of an implementation of the disclosure fully showing an unclaimed firearm positioned within the gun sock.
Figure 8:
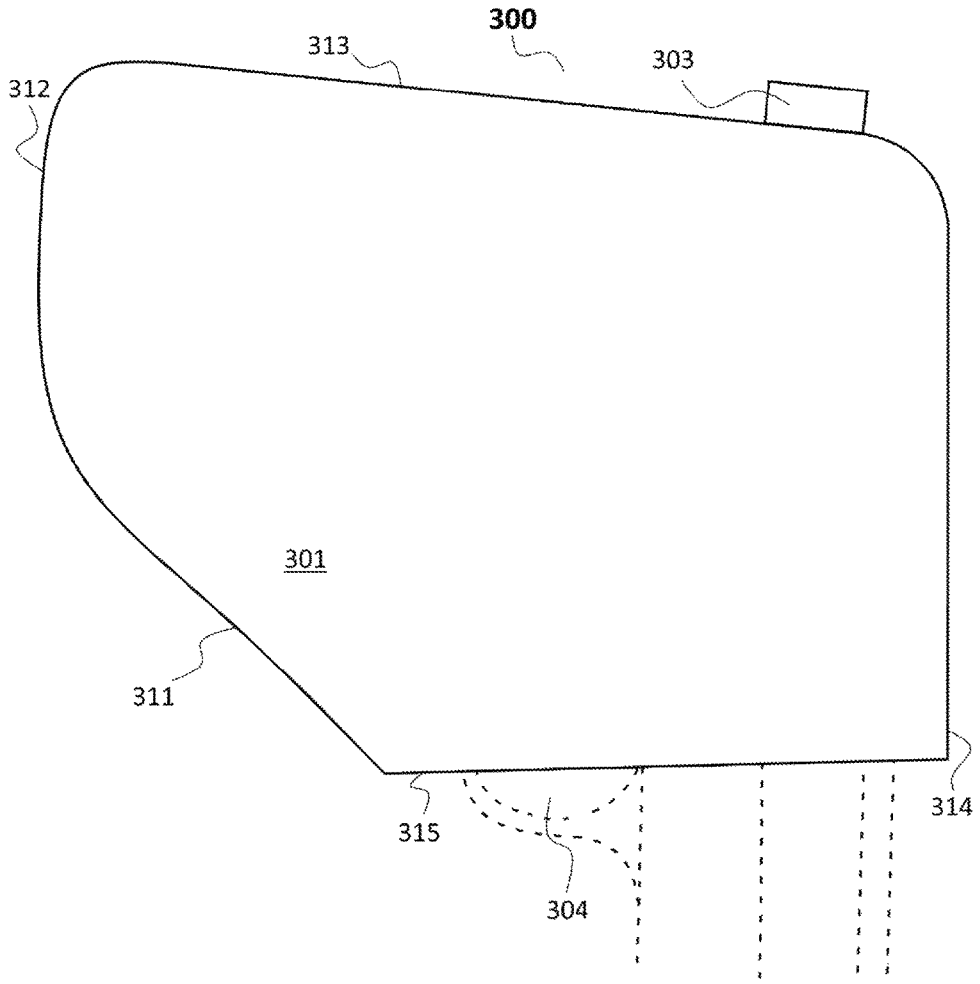
FIG. 8 shows the orthogonal side view of FIG. 7, with the unclaimed firearm only partially visible.
Figure 9:
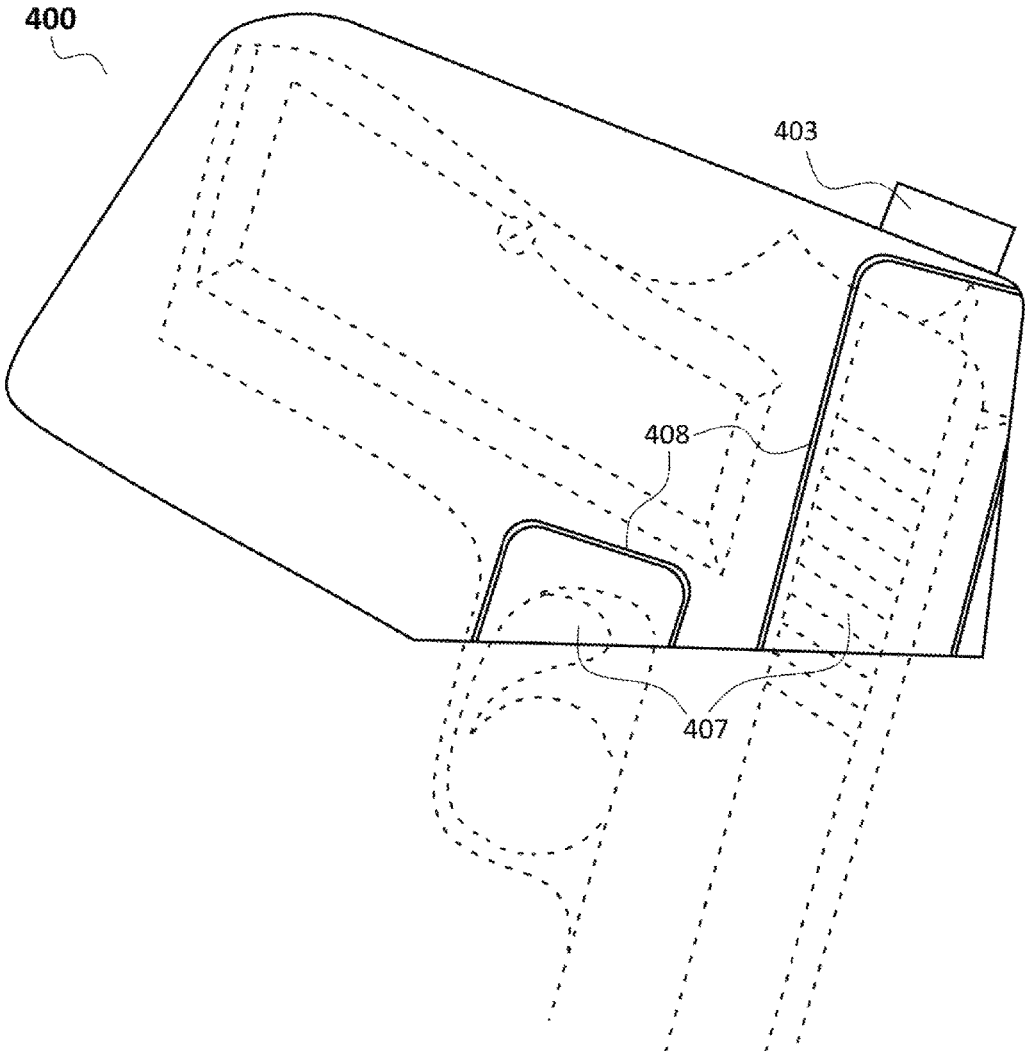
FIG. 9 shows an orthogonal side view of an implementation of the disclosure fully showing an unclaimed firearm positioned within the gun sock.
Figure 10:
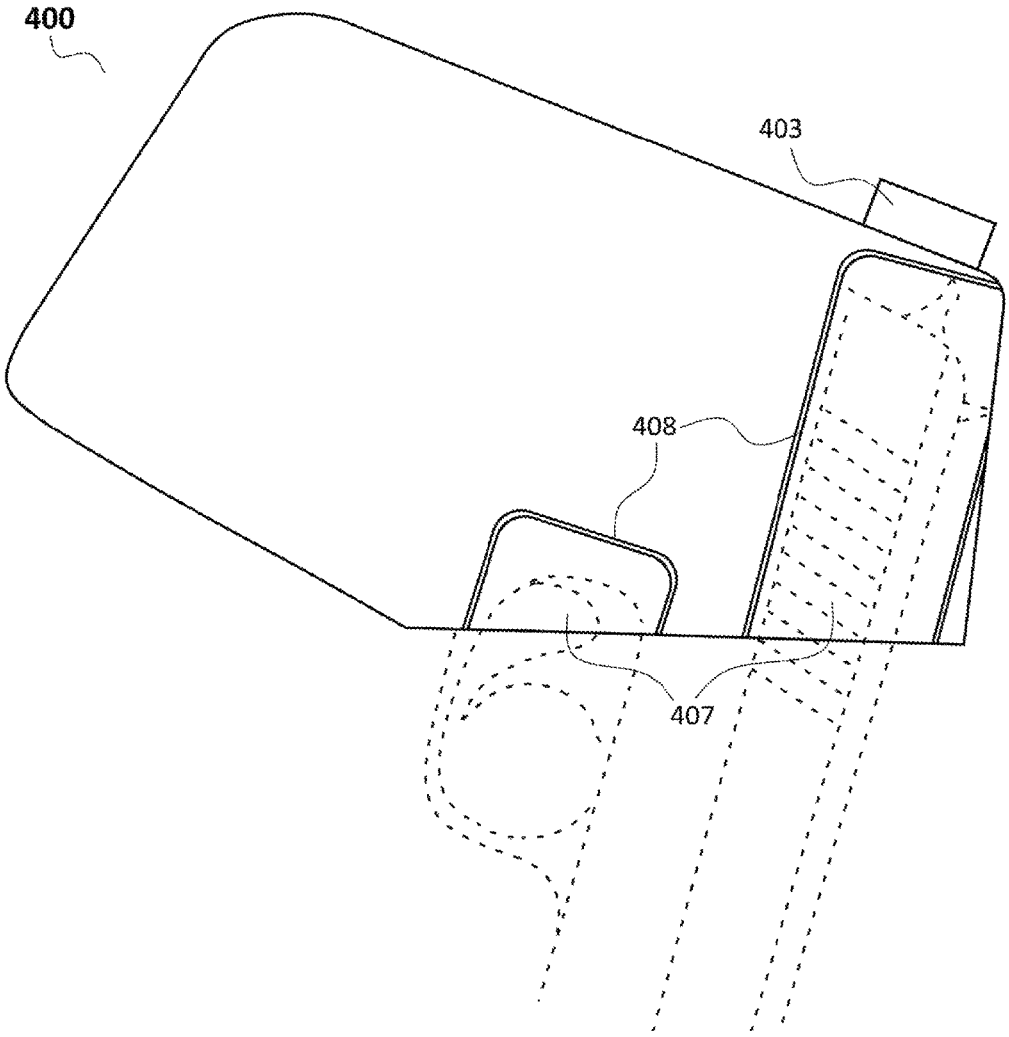
FIG. 10 shows the orthogonal side view of FIG. 9, with the unclaimed firearm only partially visible.
Figure 11:
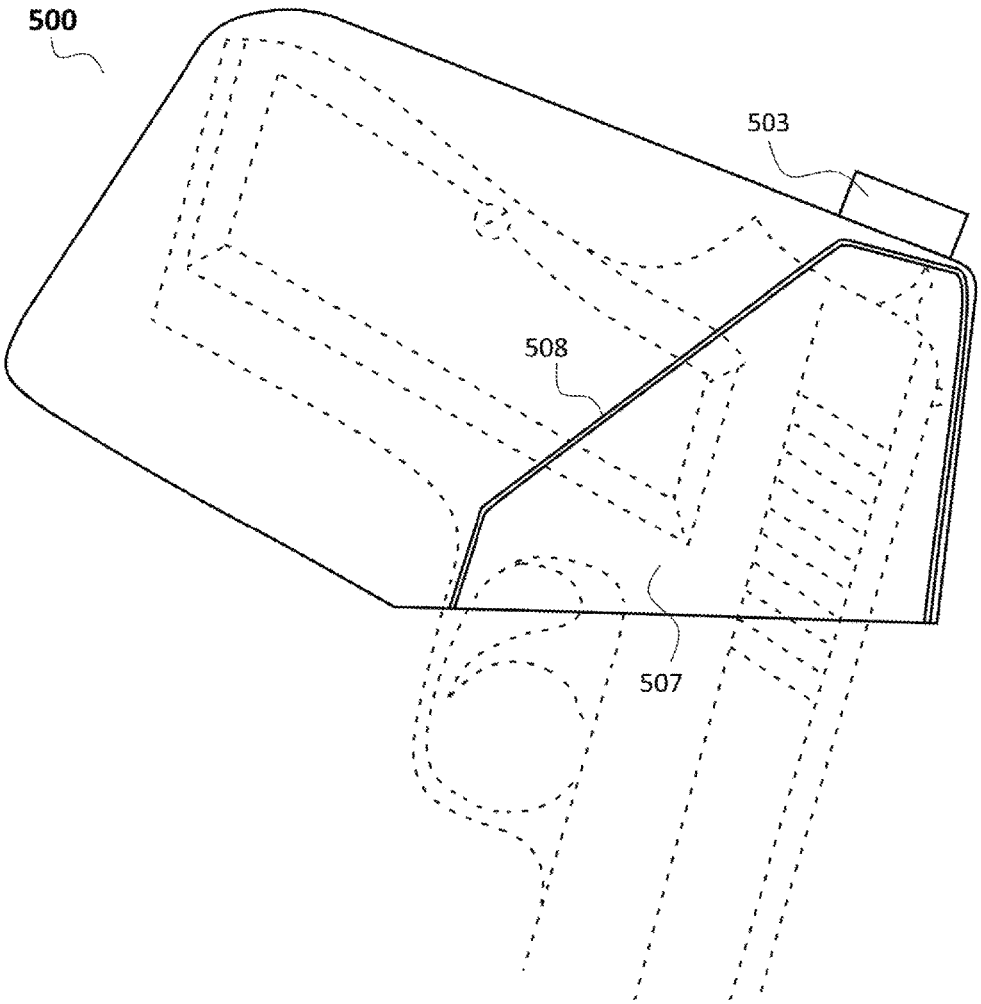
FIG. 11 shows an orthogonal side view of an implementation of the disclosure fully showing an unclaimed firearm positioned within the gun sock.
Figure 12:
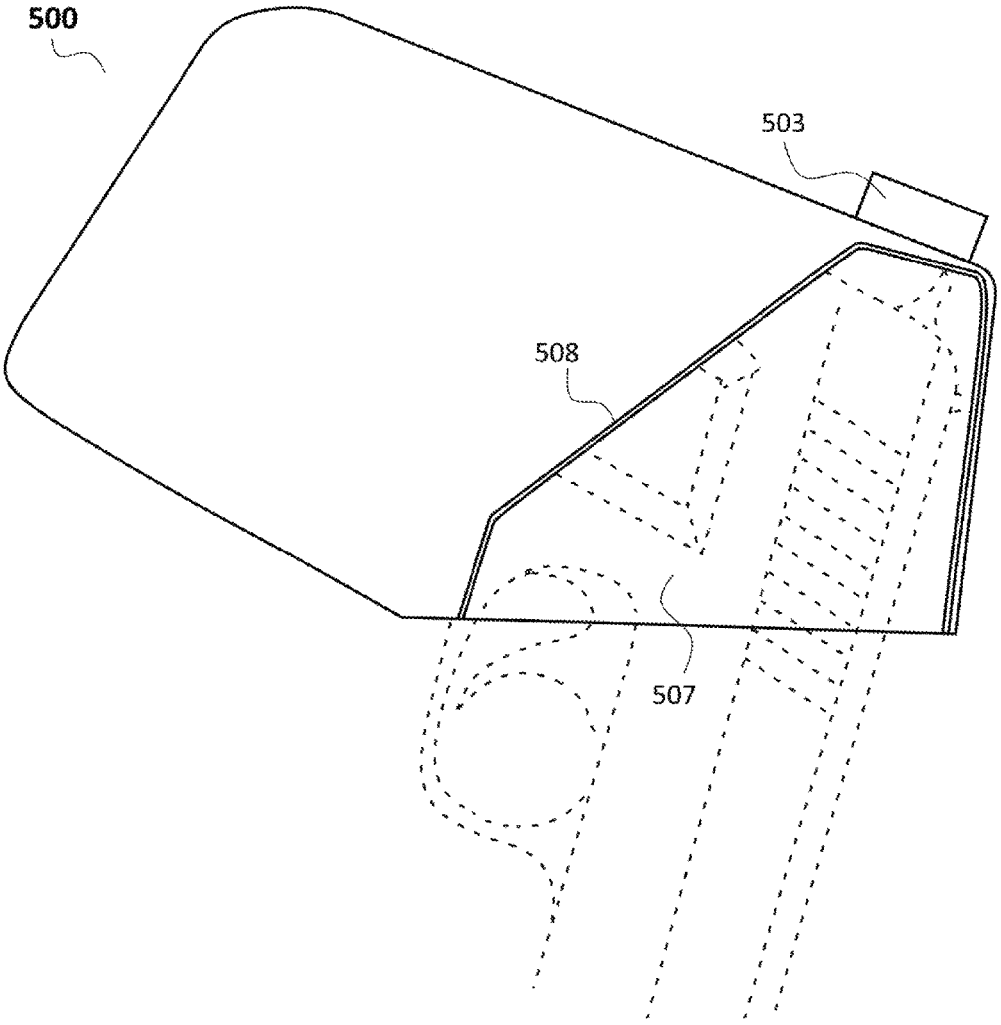
FIG. 12 shows the orthogonal side view of FIG. 11, with the unclaimed firearm only partially visible.

See FIG. 7 and FIG. 8 for another exemplary implementation referred to as gun sock 300 which is similar to gun sock 200. Like gun sock 200, gun sock 300 is substantially pentagonal. However, the shape of gun sock 300 is more accommodating to a pistol trigger guard areas and magazine wells (handle) shapes. Gun sock 300 also covers a substantial portion of the pistol trigger guard area.

The various implementations above have all featured two layers (a first layer and a second layer), however, having read the present disclosure, it will become known to those having ordinary skill in the art that other implementations being constructed entirely out of one single folded layer are possible and in some cases desirable. Though not shown in the drawings, some implementations of the present disclosure comprise one layer rather than two joined layers. Similarly, it will become known having read the present disclosure that more than two layers is used in some implementations to create the interior space that engages the pistol.

In some implementations, at least one layer is optimized or adapted for comfort. One particular intended use of the gun sock disclosed herein is for enhanced comfort of the user while carrying the pistol upon which the gun sock has been engaged. Many under-the-clothes style and hip holsters have the consequence of putting the pistol grip, handle, and hammer or slide in contact with the person's body. For example, when gun sock 100 is engaged on the pistol, the second layer 102 will be in between the person's body and the pistol parts. The second layer 102 is optimized for comfort in some implementations by selecting the second layer material of construction from the group consisting of leather, neoprene, cotton, wool, fleece, woven synthetic fibers (nylon), hide, rubber, silicone, etc. That group of material comprises the properties of flexibility, durability, comfort, and stretch. In some other implementations, the at least one layer is optimized for comfort by the addition of a cushion or padding.

In some implementations, at least one layer is optimized or adapted for breathability and heat dissipation. For example, when gun sock 100 is engaged on the pistol, the first layer 101 will be positioned on the pistol parts but facing away from the person's body. The first layer 101 is optimized for breathability and heat dissipation in some implementations by selecting the second layer material of construction from the group consisting of cotton, woven synthetic fibers, mesh, etc. That group of material comprises the properties of increased air permeability, flexibility, and stretch.

In some implementations, at least one layer is optimized or adapted for protection of the pistol surface. Certain materials of construction are known to be abrasive or otherwise cause accelerated wear on the finish of the pistol on which the gun sock is engaged. In some implementations, the gun sock is optimized for protecting the pistol surface by selecting a material of construction from the group consisting of microfiber cloth, silk, velvet, satin, fleece, leather, woven synthetic fibers (such as nylon), cotton, etc. That group of material comprises the properties of reducing friction wear on the pistol surface.

Some implementations comprise a first and second panel rather than a first and second layer, wherein each panel may be comprised of multiple sub-layers of materials having some desirable property. In some implementations the second panel consists of a first outward facing sub-layer optimized for comfort and a second inward facing sub-layer optimized to protect the pistol surface.

In some implementations, the opening further comprises an elastic band that urges the opening towards a constricted or closed position. This further improves the engagement of the gun sock with the pistol. In some implementations, the opening further comprises a draw string that can be used to constrict the opening around the pistol on which the gun sock is engaged.

Turning now to FIG. 9-12 for reference, some implementations further consist of at least one port. The port is an opening in either the first layer or the second layer that decreases the amount of the pistol that is engaged by the gun sock. The port may be separate from or connected to the opening. The at least one port may be necessary or desirable for use of the gun sock with certain holsters or carry methods. Additionally, the at least one port will increase air flow and heat dissipation. But most importantly, the at least one port further exposes the trigger area, cartridge (or case) ejection port, safety, and slide such that the pistol could be used with the gun sock still fully engaged. See ports 407 and port reinforcing 408 on FIG. 9 and FIG. 10. Also see port 507 and port reinforcing 508 on FIG. 11 and FIG. 12. This is an important structural feature for some pistol carrying people who desire the extra comfort that the gun sock will bring to their daily carry without sacrificing reaction draw times. In some implementations each of the at least one port is reinforced with either additional stitching or ribbing.

Figure 13:
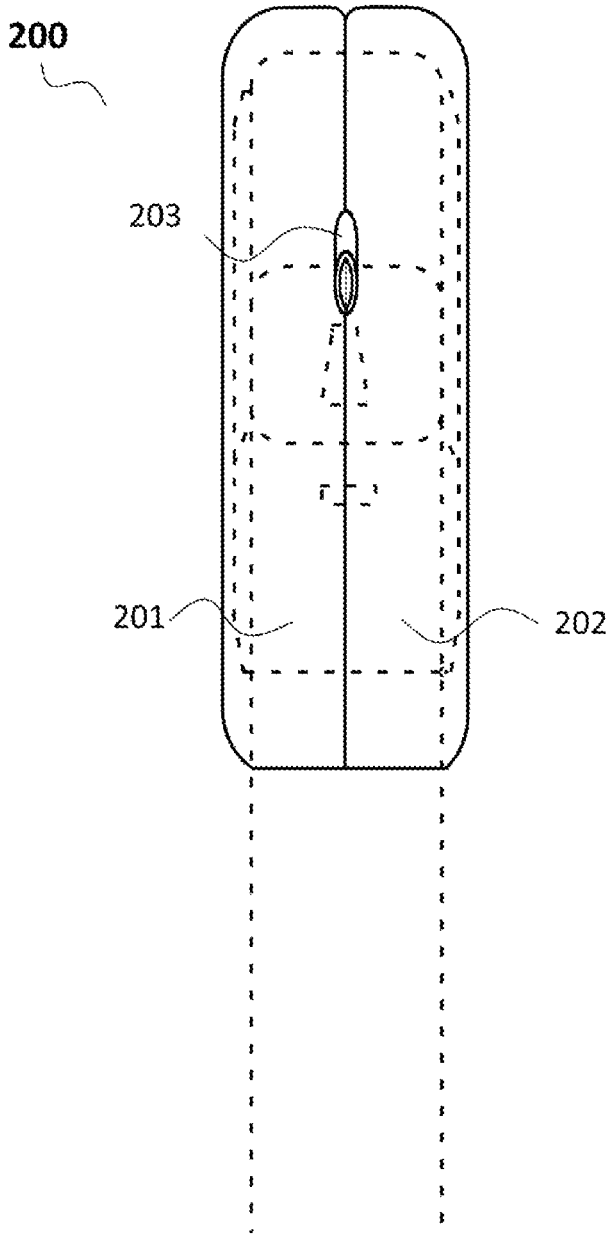
FIG. 13 shows an orthogonal side view of the edge of an implementation of the disclosure fully showing an unclaimed firearm positioned within the gun sock.
Figure 14:
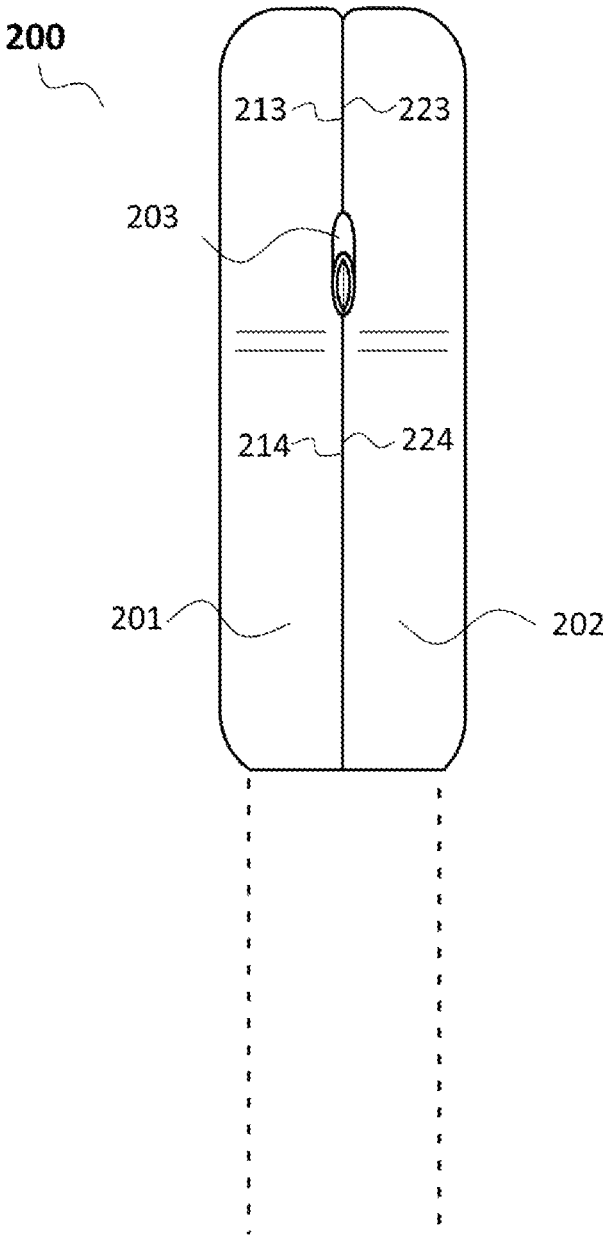
FIG. 14 shows the orthogonal side view of FIG. 13, with the unclaimed firearm only partially visible.
Figure 15:
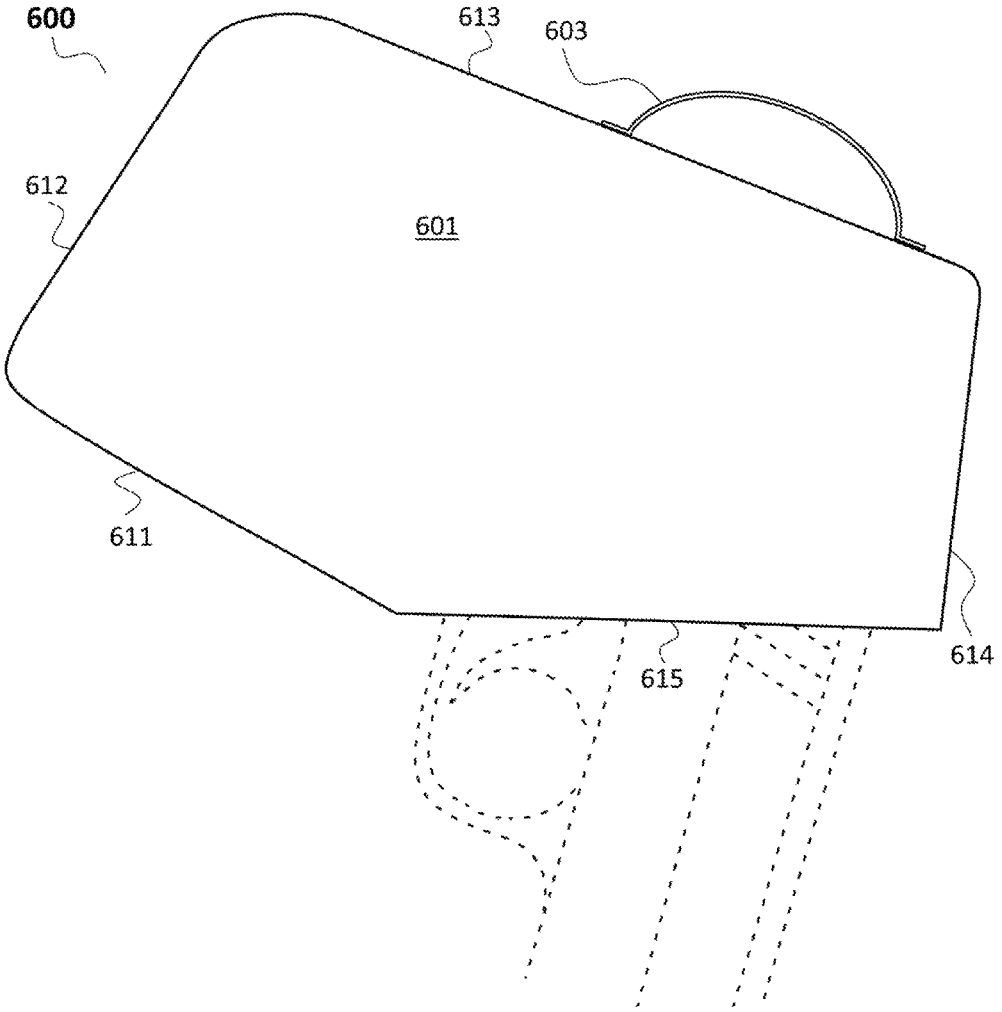
FIG. 15 shows the orthogonal side view of an implementation of the disclosure, with the partially visible unclaimed firearm positioned within the gun sock.
Figure 16:
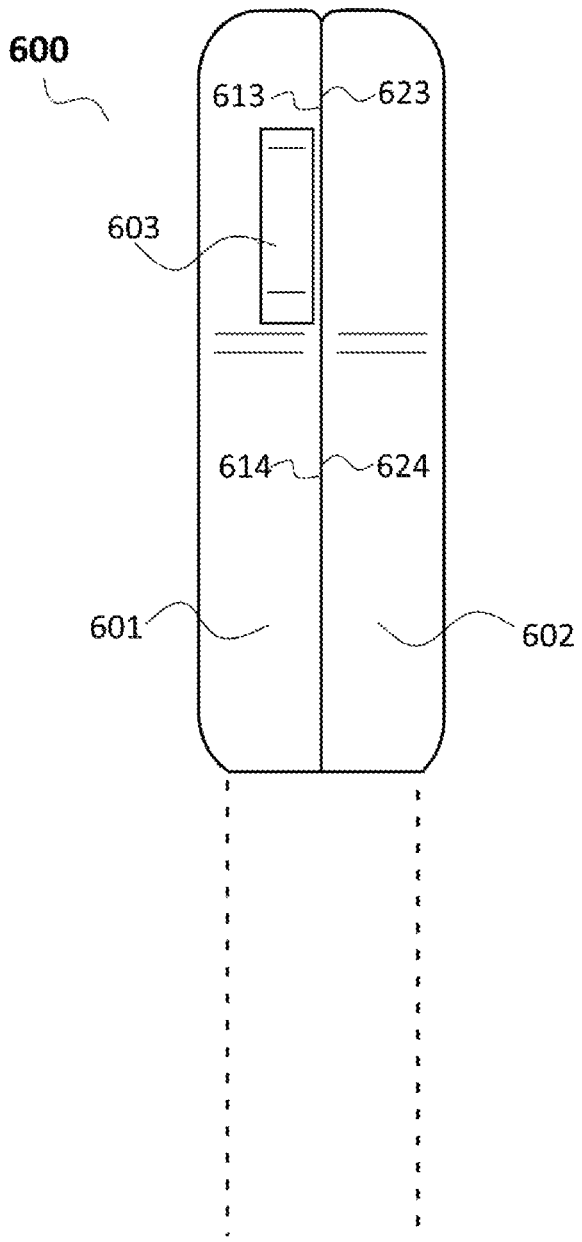
FIG. 16 shows an orthogonal side view of the edge of the implementation of FIG. 15, with the unclaimed firearm only partially visible.
Figure 17:
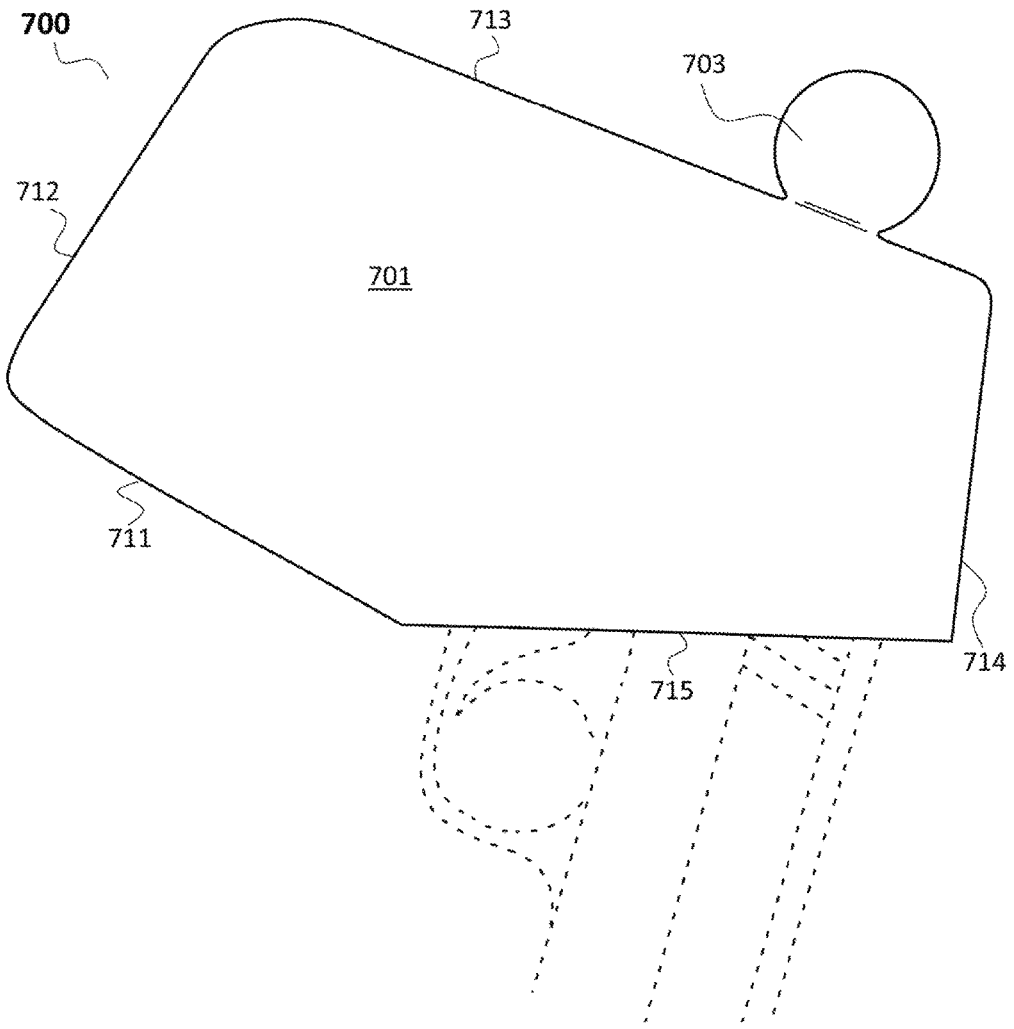
FIG. 17 shows the orthogonal side view of an implementation of the disclosure, with the partially visible unclaimed firearm positioned within the gun sock.

The implementations seen in FIG. 1-12 have shown a pull tab consisting of a small flat loop that is attached between the first layer and second layer. See FIG. 13 and FIG. 14 for more detail. However, having read the present disclosure it will become understood by one having ordinary skill in the art that the means of attachment and orientation can be modified in several ways. For example, in some implementations, such as seen in FIG. 15 and FIG. 16, the pull tab is attached to the first layer only. In some implementations, such as pull tab 603 seen in FIG. 15 and FIG. 16, the pull tab is a separate strip that has been attached to layer 601 in an orientation that is perpendicular compared to pull tab 203 of FIG. 14. Yet in other implementations, the pull tab is not a separate strip that is attached to the gun sock but rather is a tabular protrusion that extends from the gun sock. In some of those implementations, such as seen on gun sock 700 of FIG. 17, the pull tab 703 is a tabular extension of the first and second layers, 701 and 702, respectively. In some of those implementations, the pull tab is a tabular extension of at least one of the layers.

Figure 18:
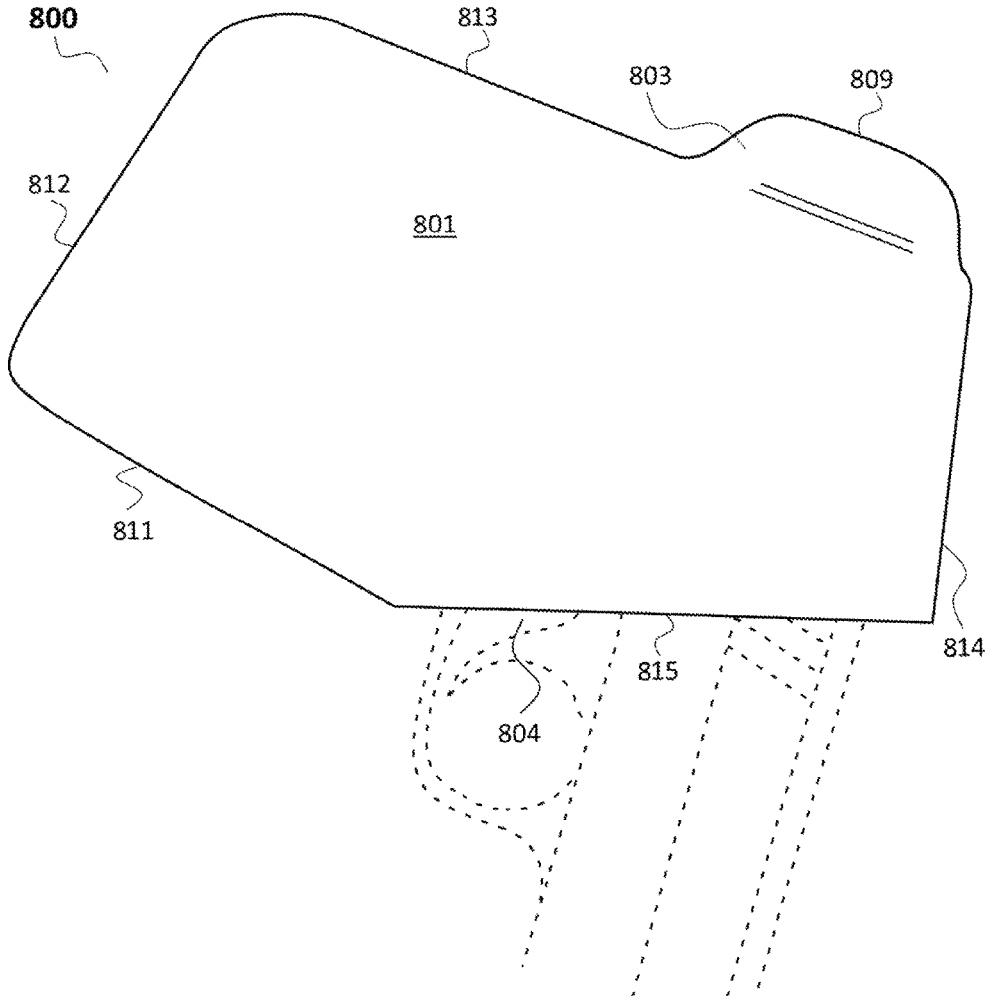
FIG. 18 shows the orthogonal side view of an implementation of the disclosure, with the partially visible unclaimed firearm positioned within the gun sock.
Figure 19:
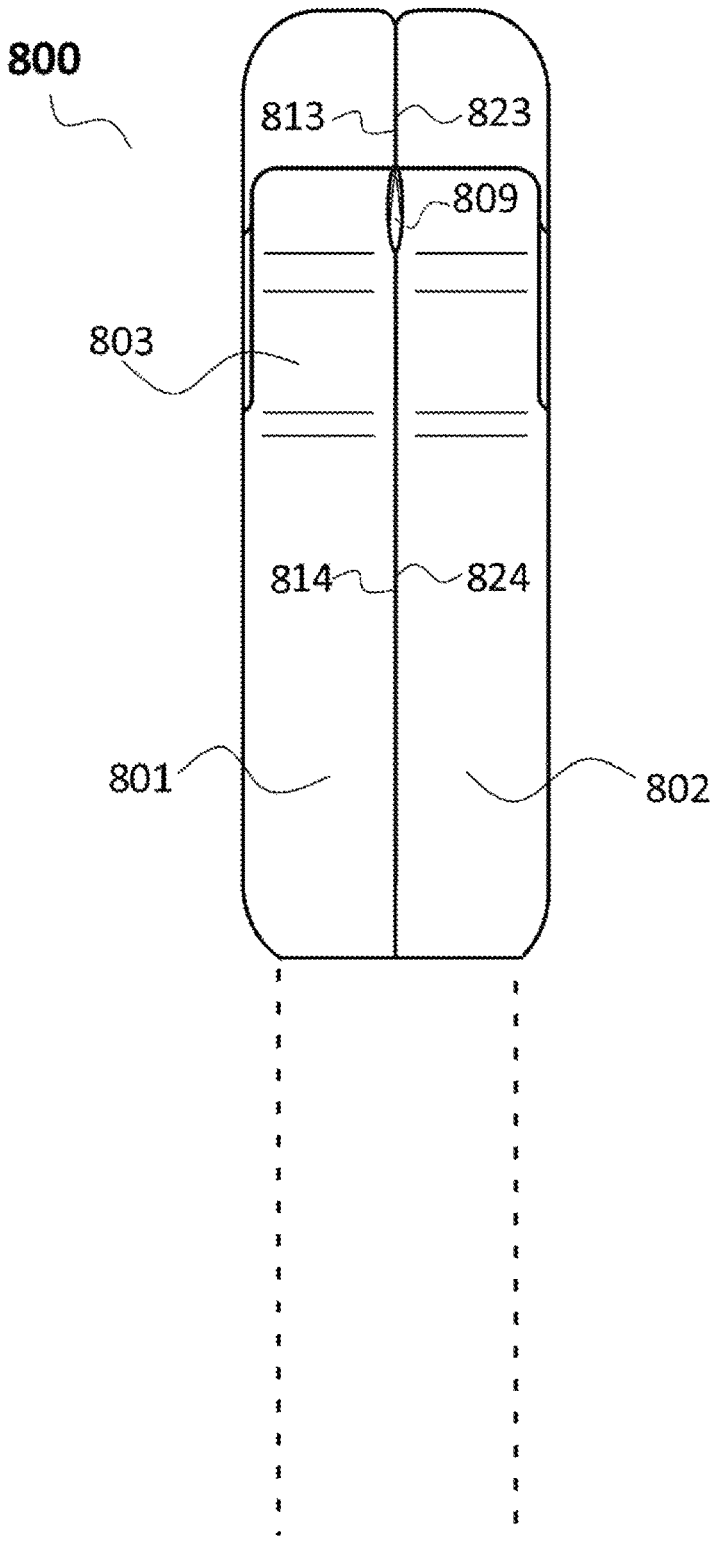
FIG. 19 shows an orthogonal side view of the edge of the implementation of FIG. 18, with the unclaimed firearm only partially visible.

Turning now to FIG. 18 and FIG. 19, the implementation referred to as gun sock 800 is similar to gun sock 700 in that the pull tab 803 is a tabular protrusion of the first layer 801 and second layer 802. However, the pull tab 803 features a distinct opening between the first layer 801 and the second layer 802. This distinct opening is referred to as the back port 809 in FIG. 18 and FIG. 19. The back port 809 is an opening that is different than the ports 407 of gun sock 400 (and ports 507 of gun sock 500), though the purpose is similar. Rather than an opening on either one of the layers or panels, the back port 809 is an opening similar to the opening 804 that is created by leaving a portion of the first layer 801 and the second layer 802 un-joined. Specifically, the section of the edge 813 (of first layer 801) that defines the apex of the pull tab 803 is left un-joined to the corresponding edge 823 (of second layer 802). In practice, this back port 809 allows the slide or hammer of a pistol having either to move back and forth with less restriction—thus the pistol may be fired more reliably while the gun sock is still engaged with the pistol.

Although the invention has been described and illustrated with a certain degree of detail or with reference to one or more particular implementations, it is understood that the present disclosure has been made only by way of example. It should be understood that the invention is not intended to be limited to the particular forms disclosed. Furthermore, the invention is amenable to various modifications and alternative forms. Obvious variations and other various changes in the composition, combination, and arrangement of parts can be utilized to by those skilled in the art without departing from the spirit and scope of the invention, as herein disclosed and claimed.

The invention claimed is:

1. A gun sock adapted to partially engage a pistol having a height and width, a handle or magazine well, a slide or hammer positioned towards the rear of the pistol, a trigger guard area, a barrel, and a muzzle positioned at the front of the pistol, the gun sock comprising:

a first layer having a first shape with a first perimeter comprised of edges;

a second layer having a second shape with a second perimeter comprised of edges that substantially matches the first shape and the first perimeter of the first layer, wherein the first layer and the second layer are at least partially joined along the first perimeter and the second perimeter such that the edges of the first layer and the edges of the second layer are divided into two groups comprised of joined edges and un-joined edges;

an interior space formed between the at least partially joined first layer and second layer that is configured to receive and engage with the pistol handle or magazine well, wherein the interior space has a depth, as measured from the un-joined edges to the joined edges of the opposing perimeter of the first shape and second shape, that exceeds the width of the pistol grip but does not exceed the distance from the trigger guard area to the rear of the pistol, wherein the rear of the pistol is the end opposite the muzzle of the pistol, and further wherein the interior space has an internal width that at least partially exceeds the sum of the pistol's height plus width;

a first opening to the interior space formed by the un-joined edges of the first layer and the second layer, wherein the first opening is positioned near the trigger of the pistol when the gun sock has received and engaged with the pistol; and a pull tab positioned along the perimeter of the first layer such that the pull tab is substantially opposite the first opening, and further wherein the pull tab is substantially aligned with the pistol slide or hammer when the gun sock is engaged with the pistol.

2. The gun sock of claim 1 further wherein the first layer and second layer are partially joined via a seam.

3. The gun sock of claim 1 further wherein the first layer and second layer are not separate structures that are partially joined but rather are one monolithic structure.

4. The gun sock of claim 1 further wherein the first layer and second layer are substantially trapezoidal in shape, such that the smallest parallel side comprises the first opening.

5. The gun sock of claim 1 wherein the pistol has a particular silhouette, further wherein the first shape of the first layer and the second shape of the second layer substantially conform to the pistol silhouette, such that when the gun sock engages the pistol, the pistol handle or magazine well is surrounded within the interior space and the first opening is positioned at and partially surrounds the pistol trigger guard area and slide, but does not surround the pistol trigger.

6. The gun sock of claim 5 wherein the pistol trigger guard area is substantially but not entirely encompassed by the interior space and the pistol trigger is entirely encompassed by the interior space.

7. The gun sock of claim 1 further wherein at least the second layer is adapted for comfort by selecting the material of construction from the group composed of leather, neoprene, cotton, wool, fleece, woven synthetic fibers (nylon), hide, rubber, and silicone.

8. The gun sock of claim 1 further wherein at least the first layer is adapted for breathability and heat dissipation by selecting the material of construction from the group composed of cotton, woven synthetic fibers, and mesh.

9. The gun sock of claim 1 further wherein the first layer and the second layer are adapted for protection of the pistol surface by selecting the material of construction from the group composed of microfiber cloth, silk, velvet, satin, fleece, leather, woven synthetic fibers (such as nylon), and cotton.

10. The gun sock of claim 1 further wherein the first layer and second layer each have at least one material of construction selected from the following group consisting of leather, neoprene, cotton, wool, fleece, woven synthetic fibers, hide, rubber, silicone, microfiber cloth, silk, velvet, and satin.

11. The gun sock of claim 1 further wherein the first layer is a first panel and the second layer is a second panel, where the first panel and the second panel are each comprised of at least one sub-layer, wherein each of the at least one sub-layer of the first and second panels has at least one material of construction selected from the following group consisting of leather, neoprene, cotton, wool, fleece, woven synthetic fibers, hide, rubber, silicone, microfiber cloth, silk, velvet, and satin.

12. The gun sock of claim 1 further comprising an elastic band positioned at the first opening.

13. The gun sock of claim 1 further comprising a draw string positioned at the first opening.

14. The gun sock of claim 1 further comprising at least a second opening positioned on the first layer such that a section of the pistol is exposed, wherein the section of the pistol that is exposed is comprised of one or more of the following group consisting of the pistol trigger area, pistol cartridge (or case) ejection port, pistol safety, and pistol slide.

15. The gun sock of claim 14 further comprising a reinforcement around each of the first opening and the second opening.

16. The gun sock of claim 1 further wherein the pull tab is a strip that is attached to the gun sock.

17. The gun sock of claim 1 further wherein the pull tab is formed by a protruding extension of the first layer and the second layer.

18. A gun sock adapted to partially engage a pistol having a height and width, a handle or magazine well, a slide or hammer positioned towards the rear of the pistol, a trigger guard area, a barrel, a muzzle positioned at the front of the pistol, and a silhouette, the gun sock comprising:

a first layer having a first shape with a first perimeter comprised of edges, wherein the first shape substantially conforms to the pistol silhouette, such that when the gun sock engages the pistol, the pistol handle or magazine well is engaged;

a second layer having a second shape with a second perimeter comprised of edges that substantially matches the first shape and the first perimeter of the first layer, wherein the first layer and the second layer are at least partially joined along the first perimeter and the second perimeter such that the edges of the first layer and the edges of the second layer are divided into two groups comprised of joined edges and un-joined edges, and further wherein the first layer and second layer have at least one material of construction selected from the following group consisting of leather, neoprene, cotton, wool, fleece, woven synthetic fibers, hide, rubber, silicone, microfiber cloth, silk, velvet, and satin;

an interior space formed between the at least partially joined first layer and second layer that is configured to receive and engage with the pistol handle or magazine well, wherein the interior space has a depth, as measured from the un-joined edges to the joined edges of the opposing perimeter of the first shape and second shape, that exceeds the width of the pistol grip but does not exceed the distance from the trigger guard area to the rear of the pistol, wherein the rear of the pistol is the end opposite the muzzle of the pistol, and further wherein the interior space has an internal width that at least partially exceeds the sum of the pistol's height plus width;

a first opening to the interior space formed by the un-joined edges of the first layer and the second layer, wherein the first opening is positioned near the trigger of the pistol when the gun sock has received and engaged with the pistol; and a pull tab positioned along the perimeter of the first layer such that the pull tab is substantially opposite the first opening, and further wherein the pull tab is substantially aligned with the pistol slide or hammer when the gun sock is engaged with the pistol, and further wherein the pull tab is formed by a protruding extension of the first layer and the second layer.

19. A gun sock adapted to partially engage a pistol having a height and width, a handle or magazine well, a slide or hammer positioned towards the rear of the pistol, a trigger guard area, a barrel, a muzzle positioned at the front of the pistol, and a silhouette, the gun sock comprising:

a first layer having a first shape with a first perimeter comprised of edges, wherein the first shape substantially conforms to the pistol silhouette, such that when the gun sock engages the pistol, the pistol handle or magazine well is engaged;

a second layer having a second shape with a second perimeter comprised of edges that substantially matches the first shape and the first perimeter of the first layer, wherein the first layer and the second layer are at least partially joined along the first perimeter and the second perimeter such that the edges of the first layer and the edges of the second layer are divided into two groups comprised of joined edges and un-joined edges, and further wherein the first layer and second layer have at least one material of construction selected from the following group consisting of leather, neoprene, cotton, wool, fleece, woven synthetic fibers, hide, rubber, silicone, microfiber cloth, silk, velvet, and satin;

an interior space formed between the at least partially joined first layer and second layer that is configured to receive and engage with the pistol handle or magazine well, wherein the interior space has a depth, as measured from the un-joined edges to the joined edges of the opposing perimeter of the first shape and second shape, that exceeds the width of the pistol grip but does not exceed the distance from the trigger guard area to the rear of the pistol, wherein the rear of the pistol is the end opposite the muzzle of the pistol, and further wherein the interior space has an internal width that at least partially exceeds the sum of the pistol's height plus width;

a first opening to the interior space formed by the un-joined edges of the first layer and the second layer, wherein the first opening is positioned near the trigger of the pistol when the gun sock has received and engaged with the pistol;

a pull tab positioned along the perimeter of the first layer such that the pull tab is substantially opposite the first opening, and further wherein the pull tab is substantially aligned with the pistol slide or hammer when the gun sock is engaged with the pistol, and further wherein the pull tab is formed by a protruding extension of the first layer and the second layer; and a second opening positioned on the first layer such that a section of the pistol is exposed, wherein the section of the pistol that is exposed is comprised of one or more of the following group consisting of the pistol trigger area, pistol cartridge (or case) ejection port, pistol safety, and pistol slide.

* * * * *